US012024968B2

(12) United States Patent
Hansen

(10) Patent No.: US 12,024,968 B2
(45) Date of Patent: Jul. 2, 2024

(54) KIT AND METHOD FOR MODIFICATION OF A HORIZONTAL VALVE TREE

(71) Applicant: CCB Subsea AS, Ågotnes (NO)

(72) Inventor: Fredrik Normann Hansen, Rådal (NO)

(73) Assignee: CCB Subsea AS, Ågotnes (NO)

( * ) Notice: Subject to any disclaimer, the term of this patent is extended or adjusted under 35 U.S.C. 154(b) by 0 days.

(21) Appl. No.: 18/034,906

(22) PCT Filed: Jan. 5, 2022

(86) PCT No.: PCT/NO2022/050001
§ 371 (c)(1),
(2) Date: May 2, 2023

(87) PCT Pub. No.: WO2022/149983
PCT Pub. Date: Jul. 14, 2022

(65) Prior Publication Data

US 2024/0018840 A1 Jan. 18, 2024

(30) Foreign Application Priority Data

Jan. 10, 2021 (NO) ..... 20210027

(51) Int. Cl.
*E21B 33/04* (2006.01)

(52) U.S. Cl.
CPC ..... *E21B 33/04* (2013.01)

(58) Field of Classification Search
CPC ..... E21B 33/04
See application file for complete search history.

(56) References Cited

U.S. PATENT DOCUMENTS 5,372,199 A 12/1994 Cegielski et al.
2008/0017368 A1 1/2008 Hopper et al.
(Continued)

FOREIGN PATENT DOCUMENTS

EP 0611874 10/1995
GB 2397312 7/2005

OTHER PUBLICATIONS

International Search Report and the Written Opinion for PCT/NO2022/050001, dated Mar. 22, 2022.
(Continued)

*Primary Examiner* — Dany E Akakpo
(74) *Attorney, Agent, or Firm* — Andrus Intellectual Property Law, LLP

(57) ABSTRACT

A kit is for modification of a horizontal valve tree to facilitate pulling of the valve tree without first having to pull a connected upper well completion having an original, first tubing hanger in a center passage in the valve tree. The kit has a tubing hanger top, a second tubing hanger and a tubing hanger adapter. The tubing hanger top has communication paths corresponding to communication paths in systems arranged downstream in or by the valve tree. The second tubing hanger has communication paths for communicating with downhole installations in a well. The tubing hanger adapter has devices for coupling the tubing hanger adapter with the tubing hanger top and the second tubing hanger, and communication paths for coupling the communication paths of the tubing hanger top with the corresponding communication paths of the second tubing hanger. A method is for modifying a valve tree via the modification kit.

4 Claims, 4 Drawing Sheets

(56) References Cited

U.S. PATENT DOCUMENTS

| | | | | |
|---|---|---|---|---|
| 2016/0245034 | A1 | 8/2016 | June | |
| 2018/0187502 | A1* | 7/2018 | Cridland | E21B 23/0411 |
| 2021/0340831 | A1* | 11/2021 | Nelson | E21B 33/04 |

OTHER PUBLICATIONS

Response to the Written Opinion for PCT/NO2022/050001, dated Jul. 7, 2022.
Written Opinion for PCT/NO2022/050001, dated Jul. 19, 2022.
Response to the Written Opinion for PCT/NO2022/050001, dated Sep. 14, 2022.
Examiner Interview Summary and Amendments for PCT/NO2022/050001, dated Sep. 23, 2022.
Norwegian Search Report for 20210027, dated Jul. 30, 2021.
International Preliminary report on Patentability for PCT/NO2022/050001, dated Sep. 29, 2022.

* cited by examiner

KIT AND METHOD FOR MODIFICATION OF A HORIZONTAL VALVE TREE

CROSS-REFERENCE TO RELATED APPLICATIONS

This application is the U.S. national stage application of International Application PCT/NO2022/050001, filed Jan. 5, 2022, which international application was published on Jul. 14, 2022, as International Publication WO 2022/149983 in the English language. The International Application claims priority of Norwegian Patent Application No. 20210027, filed Jan. 10, 2021. The international application and Norwegian application are both incorporated herein by reference, in entirety.

FIELD

The invention concerns a kit and a method for modification of a horizontal valve tree to facilitate pulling the horizontal valve tree without having to first pull a connected upper well completion that comprises an original tubing hanger that is fastened in a centre passage in the horizontal valve tree. More specifically, the invention concerns a kit and a method for changing a tubing hanger arrangement of a horizontal valve tree (HXT) from being hung off in the valve tree to the tubing hanger being hung off in a wellhead or in an adapter unit under the valve tree.

BACKGROUND

Within the field of oil and gas production from subsea structures, arranging a valve tree on the wellhead of a subsea well is known. Distinguishing between conventional, vertical valve trees (Vertical Christmas Tree—VXT) on one hand and horizontal trees (Horizontal Christmas Tree—HXT) on the other hand is known. The valve tree is provided with well barrier valves that have different tasks in production, maintenance, and security during well operations and in the production phase, where a hydrocarbon fluid flow from the well is directed up through the valve tree to a side outlet, connected to a pipe system and with a further connection to a pipeline for transport of the produced fluids.

A valve tree on an injection well controls the medium being injected into the well. In the upper part of the valve tree there are connections that provide access to the well from a surface vessel during well completion and other work operations, and where the connections are blocked during production.

A valve tree also has several functions related to process and monitoring, such as chemical injection, pressure reduction, monitoring of pressure, temperature, corrosion, erosion, sand detection and flow rate, composition of fluid flow, feedback about the status of shutoff and choke valves, as well as connections to the underside of the tubing hanger, i.e., to the well's production tubing, production tubing annulus and downhole valves and sensors.

Until the early 1990s, so-called conventional valve trees, also known as vertical valve trees (VXT), were used exclusively. These valve trees have well barrier valves in the vertical bores and are usually provided with a 5" (127 mm) main passage, known as a production or injection bore. A second, 2" (51 mm) bore in the valve tree is called the annulus bore. This bore communicates via the tubing hanger in the wellhead with the annulus between the production tubing and the well casing. The production tubing annulus is also called annulus A. There is also an annulus B that constitutes the space between the inner casing (outside the production tubing) and the next casing.

During the 1990s, the so-called horizontal valve trees (HXT) took over the subsea market. In this solution, the valves are not placed in the vertical passage, but are rather arranged in and on the side of the main body of the valve tree. The tubing hanger is hung off in a centre passage in the main body of the horizontal valve tree, and communication with the production tubing annulus of the well goes through a bore in the horizontal valve tree to the underside of the tubing hanger in the horizontal valve tree.

In the following, a vertical valve tree will also be referred to using the abbreviation VXT, and a horizontal valve tree will also be referred to using the abbreviation HXT.

In recent years, an improved type of vertical valve trees has been used. These are known in the industry as monobore VXT. They have a central production passage, preferably of a larger dimension, usually 7" (178 mm), which is also typical of a HXT, and this embodiment combines most of the advantages of horizontal and vertical valve trees.

The method for installation of the production tubing in the well is fundamentally different for VXT and HXT in that for VXT, the tubing hanger is installed in the wellhead under the valve tree. For both VXT and HXT, the production tubing is made up of pipe joints in a stepwise manner and lowered into the well through a liquid-filled marine riser that hangs from a surface vessel and that at the lower end is coupled to a subsea blowout preventer (BOP) on the seabed. In the last phase of the tubing installation in the well, the upper end of the production tubing is screwed together with a connection on the underside of a tubing hanger (TH) that on its upper end is coupled to a tubing hanger running tool (THRT). Hydraulic lines and signal communication lines for downhole safety valves, other downhole functions, and downhole instrumentation, respectively, are clamped to the production tubing as it is being lowered from the rig floor through the marine riser. When the production tubing is coupled to the tubing hanger, these lines are also coupled to the underside of the tubing hanger, which is provided with line feedthroughs. The tubing hanger, the tubing hanger running tool and the production tubing thus hang in a work string that is used during the final part of the installation, where the tubing hanger is lowered through the marine riser and is landed and locked either in the wellhead, an intermediate adapter unit, or in the horizontal valve tree, depending on the valve tree solution that applies for the subsea production system in question. When successful locking of the tubing hanger is confirmed, the tubing hanger running tool is released from the tubing hanger and pulled to the surface using the work string.

In connection with well completion for a conventional VXT, the BOP is initially locked to the wellhead after the well operation is completed, and the tubing hanger is installed and hung off in the wellhead. After installation, the production and annulus bores in the tubing hanger are isolated by the respective bores being plugged. This is a conventional method for isolating an abandoned well. The BOP and the marine riser are then pulled up to the surface vessel, and the valve tree is installed on the wellhead. A dual bore well work-over system is used for the finalising VXT well completion operations. The riser, which forms the connection to the surface vessel, has two parallel passages to the surface, one connected to the production bore and a second to the annulus bore, which for this VXT type extend down through the well intervention equipment and the valve tree to the tubing hanger. The plugs in the tubing hanger are pulled via the well work-over system before the finalising operations of perforating and cleaning up the well are carried out.

Before any pulling of the valve tree during the well's service life or at the end of the service life, the annulus bore and the production bore in the tubing hanger must be plugged again. This is done either from a surface vessel using well intervention equipment corresponding to the equipment that was used during the completion, or using an alternative system operated from a surface vessel.

During well completion with HXT, the valve tree is first locked to the wellhead. In this case, the BOP is locked to the top of the valve tree, and it is possible to carry out final drilling operations through the HXT, before the production tubing is installed in the well and the tubing hanger is finally landed and locked to a profile internally in the valve tree. It is currently common to use a so-called simplified landing string with a tubing hanger running tool when installing a tubing hanger in an HXT. In this case, the work string will consist of drill pipe joints. The work string can also be a monobore riser (work-over riser) if the tubing hanger running tool forms part of a lower part of a complete landing string, which in addition to a pipe joint with internal threads (slick joint) and a pipe joint that can be sheared using the BOP's shearing device (shear ram), is an assembly of well barrier valves (Lower Landing String Assembly—LLSA). This tool system can be used if the well is to be flowed to a test separator aboard the surface vessel in connection with cleaning of the well after perforation of the production tubing in the well.

Several of the characteristics of the HXT concept made this solution the preferred alternative from the mid-1990s, and the previous dual bore VXT concept was considered outdated. An important characteristic of the HXT solution is that the diameter of the vertical passage and the production tubing in the well became larger, typically 7" (178 mm). The increased dimension allowed for a greater production rate than VXT with a passage of 5" (127 mm) and associated production tubing. The method of HXT well completion was also seen as more effective compared to the traditional VXT operations. This perception has changed over the years. An important aspect of the philosophy behind the introduction of the HXT concept was also that it was assumed that it would be necessary to pull the completion during the service life of the wells. Under these conditions, the HXT configuration appeared advantageous. Over the years, it became evident that the need to pull the completion has been much lesser than expected. Gradually, different well work-over systems were also developed to complete simpler well operations without BOP, marine riser and landing string, possibly from a surface vessel. Some of these were based on the use of a riser, but solutions for well operations without a riser have also been developed.

Any defects on the HXT that cause the valve tree to have to be pulled to the surface for repair and work-over involves the well completion having to first be pulled to be able to retrieve the valve tree. This must be done from a drilling rig, which entails very large costs. In later years, operators have moved away from the HXT concept due to new risk assessments and because techniques and capacities for well intervention from a boat have evolved since the 1990s. A VXT can be pulled and installed using a boat operation at a fraction of the cost of a rig operation for pulling and installing an HXT.

The development is now heading in the direction of the operator companies specifying monobore VXT, which combines most of the advantages of horizontal and vertical valve trees. A monobore VXT is installed either on the wellhead or on top of an intermediate adapter unit that is locked to the wellhead (Tubing Hanger Spool—THS). The tubing hanger is then either installed and locked in the wellhead or in a profile in the through-going centre opening of a THS, which functions in a manner corresponding to a HXT main body but has no production outlet.

In connection with pulling of a VXT, the annulus bore and the production bore in the tubing hanger must be blocked. For a monobore VXT, the production bore in the tubing hanger is plugged via the central production passage of the valve tree, but there is no through-going annulus passage in the valve tree through which a plug can be installed. This is solved in different ways depending on whether the tubing hanger is installed in the wellhead or in a THS. If the VXT tubing hanger is installed in the wellhead, the annulus bore of the tubing hanger is closed using a barrier valve that forms part of the tubing hanger. If the tubing hanger is placed in a THS, it is provided with annulus isolation valves.

Since the production bore in the valve tree is centrically arranged and typically has the same dimension as an HXT, usually 7" (178 mm), it will be compatible with tools developed for the HXT system, for example a landing string for a BOP or a marine riser. It will also be compatible with simpler well work-over systems developed for HXT.

A subsea wellhead completion system that facilitates independent pulling of a production string or a valve tree is known from GB 2397312 A, wherein a tubing hanger is arranged to be able to be landed in a wellhead housing through a valve tree with a provisional, full vertical opening, i.e., 18¾" (476 mm), as for a BOP, through the entire valve tree. A valve tree centre element provided with a vertical production passage and a side outlet can thereafter be landed and locked in the vertical opening of the valve tree. The centre element includes passages that provide an interface between passages in the tubing hanger and bores in the valve tree with connection to external service lines. The upper part of the production bore is plugged in the vertical bore of the centre element. The tubing hanger and the production string can thus be pulled through the valve tree when the centre element has been removed, or the valve tree with the centre element can be disconnected from the wellhead independently of the tubing hanger in the wellhead.

Publication EP 0611874 A1 discloses a subsea wellhead and a method of retrieving a production string from the wellhead and a method of retrieving the tree from the wellhead.

SUMMARY

The purpose of the present invention is to provide an equipment and a method for upgrading existing horizontal valve trees (HXT) for reuse through reconfiguration of the tubing hanger arrangement, so that it is not necessary to pull the upper well completion in the well to retrieve the horizontal valve tree to the surface.

The purpose is fulfilled by features specified in the description below and subsequent patent claims.

A HXT tubing hanger being oriented during installation in the horizontal valve tree, so that an opening in the side of the tubing hanger corresponds to the production outlet of the horizontal valve tree, is prior art. A number of hydraulic and electric communication paths in the tubing hanger for downhole functions will thus also correspond to connection feedthroughs in the valve tree. After the tubing hanger has been landed and locked in position in the center passage of the main body of the horizontal valve tree, the connections between the control system of the valve tree and downhole installations are established by a remotely operated vehicle (ROV) screwing coupling devices from the outside of the valve tree into their respective points of contact in the tubing hanger.

Reusing a horizontal valve tree (HXT) that is upgraded for installation of a tubing hanger in the wellhead or in an adapter unit (THS) as for the monobore VXT concept, requires a modified tubing hanger configuration in the valve tree. A tubing hanger top, which can be made new or by reconstructing the original tubing hanger, is installed in the horizontal valve tree to maintain an established interface between the tubing hanger to be hung off in the wellhead, the horizontal valve tree, a control system, and well work-over systems. However, a new interface must be established on the lower end of the tubing hanger top to create communication paths to a new, second tubing hanger that is hung off in the wellhead for re-establishing the production bore, the annulus bore and the downhole functions.

For this purpose, a tubing hanger adapter is installed on the lower end of the tubing hanger top that is installed in the horizontal valve tree. The tubing hanger adapter is oriented so that it corresponds to couplings on the upper end of the second tubing hanger that is hung off in the wellhead, when the horizontal valve tree is landed and locked on the wellhead. The tubing hanger adapter is provided with a central, sealing production bore, potentially a bore for the annulus interface, and flexibly installed hydraulic and electric connectors for communication paths to downhole installations through the second tubing hanger that is hung off in the wellhead. The second tubing hanger is preferably provided with an isolation valve for the well annulus if this tubing hanger is installed directly in the wellhead. If said second tubing hanger is installed in a so-called adapter unit (THS), the isolation valve for the annulus will typically be placed on this unit.

The tubing hanger top and the tubing hanger adapter can alternatively be produced as a new, combined part.

The invention is defined by the independent patent claims. The dependent claims define advantageous embodiments of the invention.

In a first aspect, the invention concerns more specifically a kit for modifying an existing horizontal valve tree to work as a monobore vertical valve three, the kit provides a modified tubing hanger configuration to facilitate pulling of the horizontal valve tree without first having to pull a connected upper well completion that comprises an original, first tubing hanger that is fastened in a centre passage in the horizontal valve tree, characterised in that the kit comprises

- a tubing hanger top to replace the original, first tubing hanger,
- a second tubing hanger, and
- a tubing hanger adapter, wherein
- the tubing hanger top is provided with communication paths that correspond to communication paths in systems arranged downstream in or by the horizontal valve tree,
- the second tubing hanger is provided with communication paths for communicating with downhole installations in a well,
- the tubing hanger adapter comprises devices that are arranged for coupling the tubing hanger adapter with the tubing hanger top and the second tubing hanger, as well as communication paths arranged for coupling the communication paths of the tubing hanger top with the corresponding communication paths of the second tubing hanger.

The second tubing hanger may be provided with a fluid communication bore arranged for fluid communication with a downhole annulus. An effect of this is that the modified, horizontal valve tree maintains the possibility for complete monitoring of the conditions in the connected well.

The second tubing hanger may be provided with a valve arranged for closing the fluid communication bore. An effect of this is that the communication with said annulus can be closed when necessary, for example when the horizontal valve tree is pulled.

In a second aspect, the invention concerns more specifically a method for modifying an existing horizontal valve tree to work as a monobore vertical valve tree, wherein said horizontal valve tree has been connected to an upper well completion with an original, first tubing hanger that has been fastened in a centre passage in the horizontal valve tree, characterised in that the method comprises the steps of:

a) providing a modification kit according to the first aspect of the invention;
b) hanging off the second tubing hanger in the wellhead;
c) coupling the tubing hanger adapter with the tubing hanger top that replaces the original, first tubing hanger (10); and either
d1) coupling the horizontal valve tree (1) with the wellhead (2), and
d2) inserting the assembly of the tubing hanger adapter and the tubing hanger top into the horizontal valve tree to coupling of the tubing hanger adapter with the second tubing hanger, or
e1) inserting the assembly of the tubing hanger adapter and the tubing hanger top into the horizontal valve tree, and then
e2) coupling the horizontal valve tree and the installed assembly of the tubing hanger adapter and the tubing hanger top with the wellhead so as to couple the tubing hanger adapter and the second tubing hanger; and
f) establishing communication paths from the tubing hanger top via the tubing hanger adapter and the first tubing hanger to systems connected downstream in or by the horizontal valve tree.

BRIEF DESCRIPTION OF THE DRAWINGS

In the following, an example is described of a preferred embodiment, which is illustrated in the attached drawings, wherein.

DETAILED DESCRIPTION OF THE DRAWINGS

All position indicators refer to the position shown on the figures.

The same or corresponding elements are indicated with the same reference number on the figures. For the sake of clarity some elements may not have reference numbers on some of the figures.

A person skilled in the art will understand that the figures are only principle drawings. The relative ratio between individual elements may also be distorted.

Figure 1:
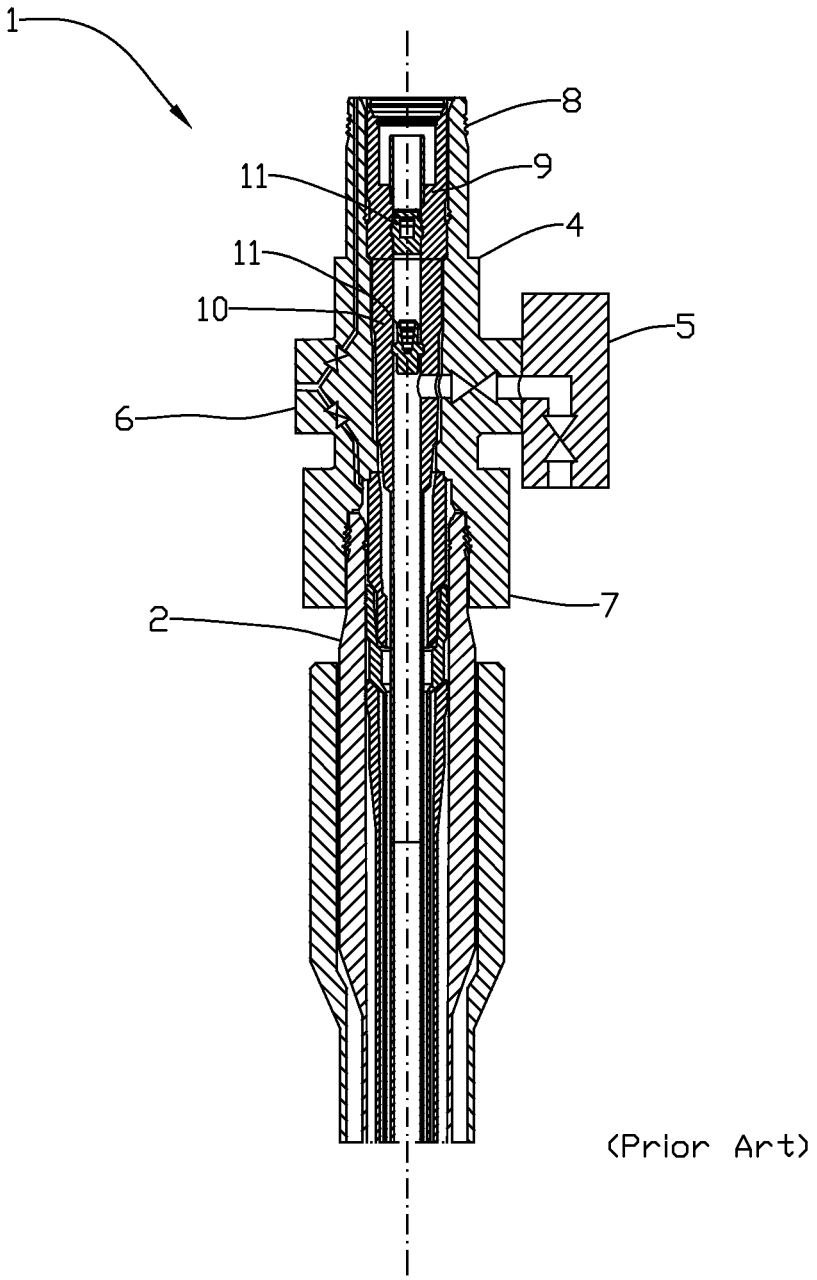
FIG. 1 shows in an axial section a horizontal valve tree (HXT) arrangement according to prior art, wherein a first tubing hanger is hung off in the horizontal valve tree.

Reference is first made to FIG. 1, wherein the reference number 1 denotes a horizontal valve tree according to prior art coupled to a wellhead 2. The horizontal valve tree 1 is constructed of a main body 4 with a production wing block 5, an annulus wing block 6 and a wellhead connector 7. An upper end of the main body 4 of the horizontal valve tree 1 is designed with a wellhead profile 8 for coupling of a BOP (not shown) or a well work-over system (not shown). Internally in the wellhead profile 8, a valve tree cap 9 is disposed. An original, first tubing hanger 10 is installed in a centre passage in the main body 4 of the horizontal valve tree 1 and forms a fluid communication between the well and the production wing block 5. Before production start, the centre passage of the horizontal valve tree 1 is plugged with crown plugs 11 installed in the valve tree cap 9 and in the first tubing hanger 10 respectively in a per se known manner.

Figure 2:
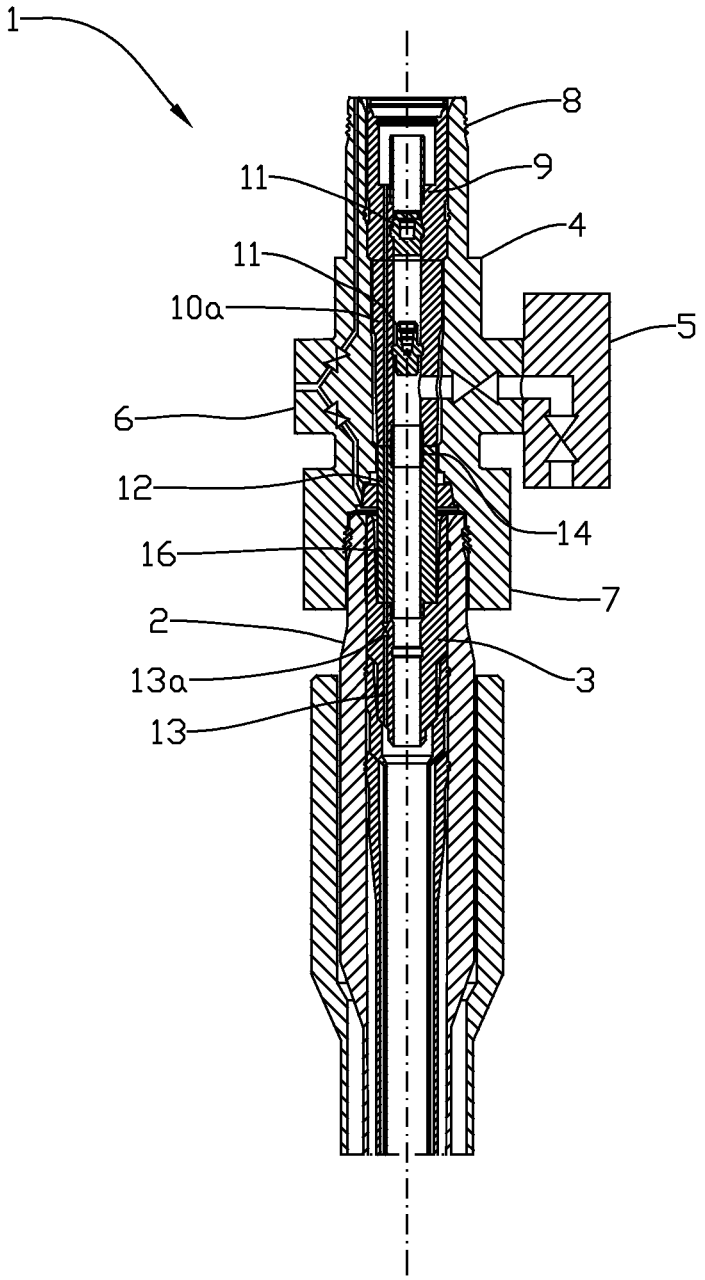
FIG. 2 shows in an axial section a horizontal valve tree upgraded in that it is provided with a modification kit comprising a tubing hanger top, a tubing hanger adapter and a second tubing hanger hung off in a wellhead.

Reference is then made to FIG. 2. Here, the horizontal valve tree 1 is shown in an upgraded embodiment. A second tubing hanger 3 is hung off in the wellhead 2 and is thereby hung off independently of the horizontal valve tree 1.

When a horizontal valve tree 1 is to be modified, a modification kit is provided that comprises a tubing hanger top 10*a*, a tubing hanger adapter 12 as well as the second tubing hanger 3.

Installation of the second tubing hanger 3 with upper completion and installation of the horizontal valve tree 1 with the tubing hanger top 10*a* and the tubing hanger adapter 12 are separate operations that may not be carried out of from the same vessel.

The second tubing hanger 3 is inserted down into the wellhead 2 and hung off there in connection with well completion after drilling of the well is completed and before the horizontal valve tree 1 is installed. An assembly of the tubing hanger top 10*a* and the tubing hanger adapter 12, where the tubing hanger adapter 12 is fastened to the underside of the tubing hanger top 10*a*, is inserted into the horizontal valve tree 1, the tubing hanger adapter 12 being arranged to provide communication paths 16 and 17 (see FIGS. 3, 4, 5 and 6) between the tubing hanger top 10*a* and the second tubing hanger 3 after the horizontal valve tree 1 has been coupled to the wellhead 2. An orientation device (not shown) orients the assembly of the tubing hanger top 10*a* and the tubing hanger adapter 12 in relation to the second tubing hanger 3 in connection with the installation of the horizontal valve tree 1. The assembly of the tubing hanger top 10*a* and the tubing hanger adapter 12 can be installed in the horizontal valve tree 1 before the horizontal valve tree 1 is coupled to the wellhead 2, or the assembly of the tubing hanger top 10*a* and the tubing hanger adapter 12 can be installed in the horizontal valve tree 1 when the horizontal valve tree 1 has been landed and locked to the wellhead 2.

Since the original tubing hanger 10 (see FIG. 1) has been replaced by the tubing hanger top 10*a*, which is designed identically to the upper portions of the original, first tubing hanger 10, the tubing hanger top 10*a* is also called a «false tubing hanger», since this tubing hanger top 10*a* only provides the upper portions of the communication paths that the original, first tubing hanger 10 exhibited through the horizontal valve tree 1, including the fluid communication to the production wing block 5.

Figure 3:
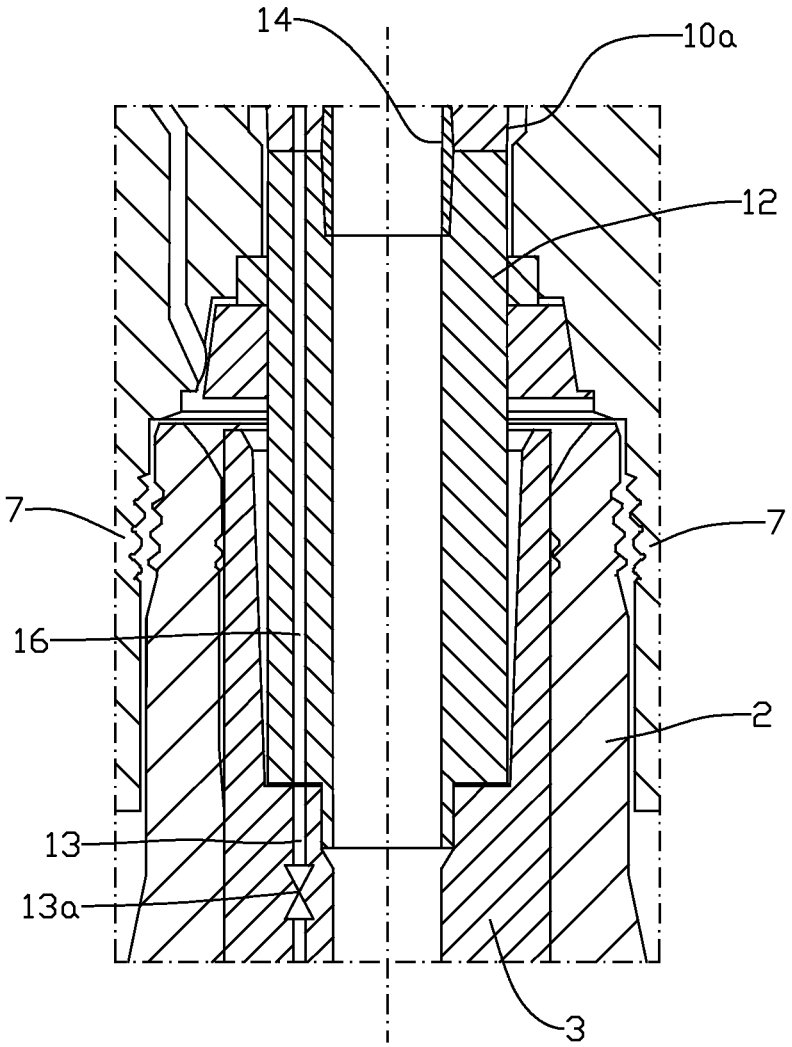
FIG. 3 shows an axial section of a detail of FIG. 2 in a larger scale.

Reference is then made to FIG. 3 for further details. The tubing hanger adapter 12 is fastened on the lower end of the tubing hanger top 10*a*. The tubing hanger top 10*a* can be a modified, existing tubing hanger for a horizontal valve tree. On the drawings, the tubing hanger top 10*a* and the tubing hanger adapter 12 are shown as separate, coupled parts. If a new tubing hanger top 10*a* is to be provided, it would be advantageous for it to be combined with the tubing hanger adapter 12, so that they form a unit. This will reduce the complexity of the equipment.

There are two alternatives for installation of the tubing hanger top 10*a* and the tubing hanger adapter 12:

a) the tubing hanger top 10*a* and the tubing hanger adapter 12 are installed in the valve tree 1 before being installed on the wellhead 2, or;

b) the tubing hanger top 10*a* and the tubing hanger adapter 12 are installed in the valve tree 1 when the valve tree 1 has been landed and locked to the wellhead 2. This necessitates an extra operational step but can ease orientation of the lower end of the tubing hanger adapter 12 in relation to the couplings on the upper end of the second tubing hanger 3 in the wellhead 2.

On the upper side, the tubing hanger adapter 12 communicates with corresponding communication paths in the tubing hanger top 10*a*. Before or in connection with the valve tree installation, the tubing hanger top 10*a* and the tubing hanger adapter 12 will be inserted into the main body 4 of the horizontal valve tree 1, so that fluid communication is created between the production bore of the tubing hanger adapter 12 and the fluid path of the production wing block 5 via the centre passage of the tubing hanger top 10*a*. In connection with valve tree installation, after well completion is carried out, the tubing hanger adapter 12 is also oriented in relation to the tubing hanger 3 in the wellhead 2, so that the tubing hanger adapter 12 on the underside corresponds to couplings on the upper end of the second tubing hanger 3.

For installation in the wellhead as shown by FIGS. 2 and 3, the second tubing hanger 3 is provided with the fluid communication bore 13, which can be closed using an isolation valve 13*a* for closing off a well annulus. If the second tubing hanger 3 is to be installed in a so-called adapter unit (THS) (not shown), the isolation valve 13*a* for the annulus communication can be excluded, a corresponding shut-off valve preferably being placed on said adapter unit. After well completion and pending installation of the valve tree 1, the isolation valve 13*a* is closed, and the production bore in the tubing hanger 2 is plugged. The plug is removed when the valve tree 1 is in place by means of a well intervention system (not shown).

Figure 4:
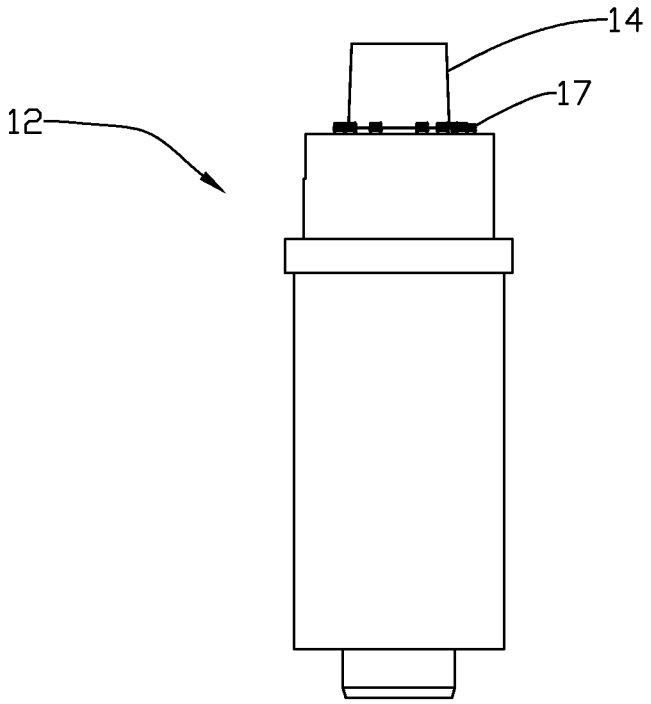
FIG. 4 shows in a smaller scale, a side sketch of the tubing hanger adapter for communication with the tubing hanger in the wellhead.
Figure 5:
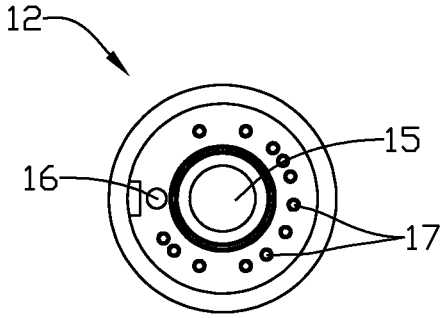
FIG. 5 shows an end sketch of the tubing hanger adapter seen from above.
Figure 6:
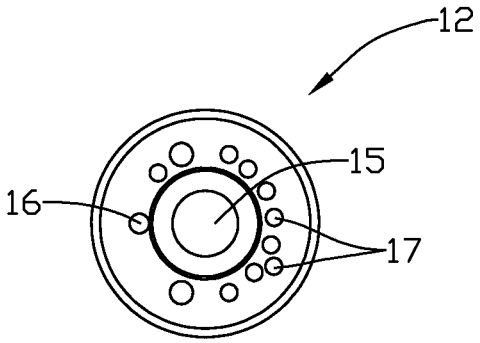
FIG. 6 shows an end sketch of the tubing hanger adapter seen from below.

Reference is then made to FIGS. 4, 5 and 6. The tubing hanger adapter 12 is provided with a central production bore 15, a fluid communication path 16 for communication with the underlying annulus, and flexibly installed hydraulic and electric connectors 17 for providing communication path with downhole installations via the tubing hanger top 10*a* and the second tubing hanger 3. Fastening and coupling details between the tubing hanger adapter 12 and the lower part of the tubing hanger top 10*a* are not shown, except for a sealing coupling sleeve 14 in the central production bore 15, in the interface between the parts.

The second tubing hanger 3 is oriented so that the communication paths in the second tubing hanger 3 will correspond to the communication paths 16, 17 of the tubing hanger adapter 12 in the subsequent installation of the horizontal valve tree 1. An orientation device (not shown) between the second tubing hanger 3 and the tubing hanger adapter 12 ensures these are oriented correctly, the lower end of the tubing hanger adapter 12 entering the upper part of the second tubing hanger 3, whether the tubing hanger top 10*a* and the tubing hanger adapter 12 are installed together with the valve tree 1 or as a subsequent operation.

It should be noted that all embodiments mentioned above illustrate the invention, but do not delimit it, and experts on the subject will be able to design many alternative embodiments without deviating from the scope of the attached claims. In the claims, the reference numbers in parenthesis shall not be considered delimiting.

The use of the verb "to comprise" and its different forms does not exclude the presence of elements or steps not mentioned in the claims. The indefinite articles "a" or "an" before an element do not exclude the presence of more such elements.

The invention claimed is:

1. A kit for modifying an existing horizontal valve tree to work as a monobore vertical valve tree, the kit provides a modified tubing hanger configuration to facilitate pulling the horizontal valve tree without first having to pull a connected upper well completion that comprises an original, first tubing hanger that is fastened in a center passage in the horizontal valve tree, wherein the kit comprises:

a tubing hanger top to replace the original, first tubing hanger, a second tubing hanger, and a tubing hanger adapter, wherein the tubing hanger top is provided with communication paths that correspond to communication paths in systems arranged downstream in or by the horizontal valve tree, the second tubing hanger is provided with communication paths for communicating with downhole installations in a well, the tubing hanger adapter comprises devices that are arranged for coupling the tubing hanger adapter with the tubing hanger top and the second tubing hanger, as well as communication paths arranged for coupling the communication paths of the tubing hanger top with the corresponding communication paths of the second tubing hanger.

2. The modification kit according to claim 1, wherein the second tubing hanger is pro-vided with a fluid communication bore arranged for fluid communication with a downhole annulus.

3. The modification kit according to claim 2, wherein the second tubing hanger is provided with an isolation valve arranged to be able to close the fluid communication bore.

4. A method for modifying an existing horizontal valve tree to work as a monobore vertical valve tree, wherein said horizontal valve tree is connected to an upper well completion with an original, first tubing hanger that is fastened in a center passage in the horizontal valve tree, wherein the method comprises the steps of:

a) providing a modification kit according to claim 1;

b) hanging off the second tubing hanger in a wellhead;

c) coupling the tubing hanger adapter with the tubing hanger top that replaces the original, first tubing hanger; and either d1) coupling the horizontal valve tree with the wellhead, and d2) inserting the assembly of the tubing hanger adapter and the tubing hanger top into the horizontal valve tree to coupling of the tubing hanger adapter with the second tubing hanger, or e1) inserting the assembly of the tubing hanger adapter and the tubing hanger top into the horizontal valve tree, and then e2) coupling the horizontal valve tree and the installed assembly of the tubing hanger adapter and the tubing hanger top with the wellhead so as to couple the tubing hanger adapter and the second tubing hanger; and f) establishing communication paths from the second tubing hanger via the tubing hanger adapter and the tubing hanger top to systems connected downstream in or by the horizontal valve tree.

* * * * *